US007037280B1

(12) United States Patent
Burns et al.

(10) Patent No.: US 7,037,280 B1
(45) Date of Patent: May 2, 2006

(54) FOOT MASSAGING SYSTEM

(75) Inventors: Sean T. Burns, Columbia, SC (US); Kenneth J. Morrison, Perryville, MD (US); Robert E. Bower, New Market, MD (US)

(73) Assignee: Bowles Fluidic Corporation, Columbia, MD (US)

( * ) Notice: Subject to any disclaimer, the term of this patent is extended or adjusted under 35 U.S.C. 154(b) by 265 days.

(21) Appl. No.: 10/442,236

(22) Filed: May 21, 2003

Related U.S. Application Data

(60) Division of application No. 09/816,779, filed on Mar. 26, 2001, now Pat. No. 6,572,570, and a continuation-in-part of application No. 09/773,631, filed on Feb. 2, 2001, now abandoned.

(60) Provisional application No. 60/192,395, filed on Mar. 27, 2000.

(51) Int. Cl.
*A61H 19/00* (2006.01)

(52) U.S. Cl. ..... 601/149; 601/151

(58) Field of Classification Search ..... 601/149–152, 601/70, 69
See application file for complete search history.

(56) References Cited

U.S. PATENT DOCUMENTS

| | | | | |
|---|---|---|---|---|
| 3,390,674 | A * | 7/1968 | Jones | 601/150 |
| 4,278,110 | A * | 7/1981 | Price et al. | 137/805 |
| 4,513,736 | A * | 4/1985 | Thurber | 601/57 |
| 4,780,916 | A | 11/1988 | Sutton | 4/543 |
| 5,050,591 | A | 9/1991 | Sandrin | 128/65 |
| 5,418,984 | A | 5/1995 | Livingston, Jr. | 4/541.1 |
| 6,009,574 | A | 1/2000 | Moreland | 4/541.5 |
| 6,036,663 | A | 3/2000 | Arzt et al. | 601/156 |
| 6,186,964 | B1 | 2/2001 | Branham | 601/148 |
| 6,361,512 | B1 * | 3/2002 | Mackay et al. | 601/150 |
| 6,632,188 | B1 * | 10/2003 | Thomas et al. | 601/152 |
| 2004/0082886 | A1 * | 4/2004 | Timpson | 601/15 |

* cited by examiner

*Primary Examiner*—Michael A. Brown
(74) *Attorney, Agent, or Firm*—Jim Zegeer

(57) ABSTRACT

A submerge massaging system controlled by a no-moving part backload responsive fluidic switch.

3 Claims, 7 Drawing Sheets

FOOT MASSAGING SYSTEM

REFERENCE TO RELATED APPLICATIONS

The present application is a divisional application of Ser. No. 09/816,779 filed Mar. 26, 2001, now U.S. Pat. No. 6,572,570, which in turn is the subject of provisional application No. 60/192,395 filed Mar. 27, 2000 and a CIP of Ser. No. 09/773,631 filed Feb. 2, 2001, now abandoned. The application is also related to U.S. application Ser. No. 09/567,890 filed May 10, 2000.

BACKGROUND AND BRIEF DESCRIPTION OF THE INVENTION

The present invention relates to massaging seats for hot tubs, spas, jacuzzis, swimming pools and ordinary bathtubs. In the past, commercially available massaging systems have been controlled by a system of mechanical valves and the like. See, for example, U.S. Pat. No. 6,036,663 which discloses a hydromassage chair which has such a valving system, U.S. Pat. No. 6,186,964 B1 for hydromassage pillow system; Moran U.S. Pat. No. 6,009,574 for a method and apparatus for providing a pulsed water massage; U.S. Pat. No. 4,780,916 for a tub seat massager; and U.S. Pat. No. 5,050,591 for a flexible water massage mat; and U.S. Pat. No. 5,418,984 for a hydrotherapy seat structure for a hydrotherapy spa, tub or swimming pool. For the most part, systems require moving parts and the like for operation.

The present invention provides a seat comprised of a number of bladders positioned in a hot tub, spa, jacuzzi, swimming pool or ordinary bathtub. Upon operation, the bladder is filled and emptied repeated under the control of a fluidic controller providing a slow, soothing and therapeutic apparatus. The fluidic switch controller has an input and multiple outputs, and a given bladder will inflate until the backpressure caused by the filled bladder cause the output of the fluidic switch to switch to the next bladder in the series. At this point, the first bladder deflates through a vent in the fluidic controller and the sequence continues with the bladders inflating or filling and deflating emptying based on the backpressure. The operating fluid can be either air or water.

The invention provides the user with a gentle therapeutic whole-body massage through the alternate inflation and deflation of multiple bladders. The inflation and deflation is controlled through a fluidic controller device. Upon activation the working fluid is pumped into the fluidic controller which initially directs the fluid into the bladder or bladders connected to one of the outputs. These bladders continue to fill until a pressure is reached within the bladders at which time the fluidic switches its output to the other side and inflates those bladders. As stated above, the originally inflated side deflates by venting the fluid through special vent ports. This alternating inflation and deflation continues as long as fluid is being pumped through the fluidic. The operating fluid could be air or water or a combination of both. If water is used the fluidic can be submerged and allowed to vent into the water. Frequency and intensity of the massage can be controlled through flow rate adjustments and by the design of the fluidic circuit.

The bladders could be encased in cushions and could be finely perforated, such that when air is used as the working fluid the air will bleed through holes in the bladders to create a bubbly effect. The perforations would have to be small enough so that pressure accumulated in the bladder sufficiently to create the backpressure necessary for correct operation.

The system could be integrated into a spa by the original equipment manufacturer (OEM) or offered as an aftermarket add-on system. In the OEM configuration the supply to the fluidic switch controller would be plumbed in. Alternatively, the supply to the fluidic could be through the attachment of an adapter to one of the nozzles typically used in hot tubs, spas, etc. In addition to the normal cushion bladders, a system could include bladders configured in a pocket arrangement into which the user would insert their feet. The bladders would be connected to the fluidic in such a way that alternately inflated bladders alternately apply pressure on the tops and soles of the feet, respectively.

BRIEF DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
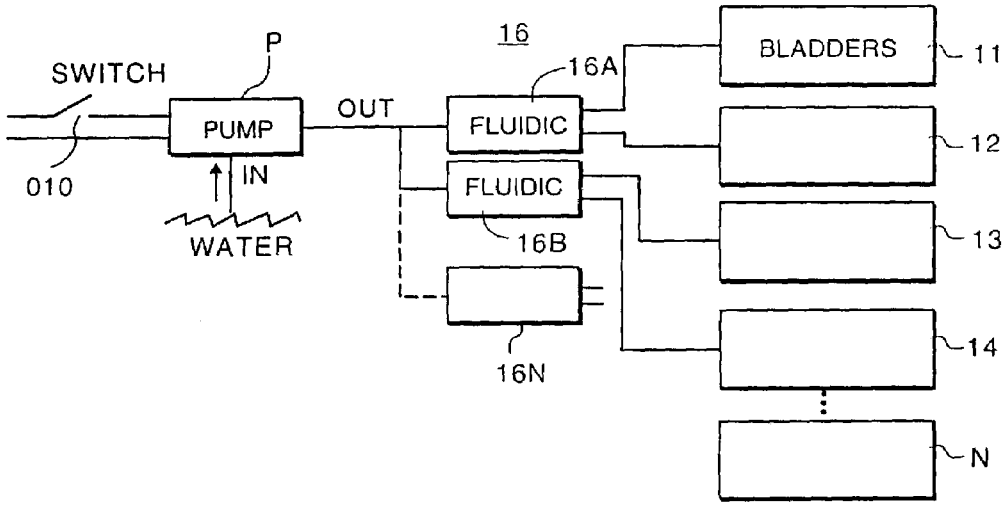
FIG. 1 is a system schematic of a fluidically driven massaging seat system.

As noted above, the invention can be applied to hot tubs, spas, jacuzzis, swimming pools and ordinary bathtubs. Referring to the drawings, a seat 10 comprised of a number of bladders 11, 12, 13 and 14N is mounted or positioned on the wall 15W of the tub 15. Upon operation, the bladders alternately fill and empty repeatedly under the control of a pair of fluidic controllers 16 providing a slow, soothing and therapeutic massage. Each fluidic controller 16, 16B, 16N is best shown in FIGS. 5A–5D and is described more fully hereafter.

Figure 2:
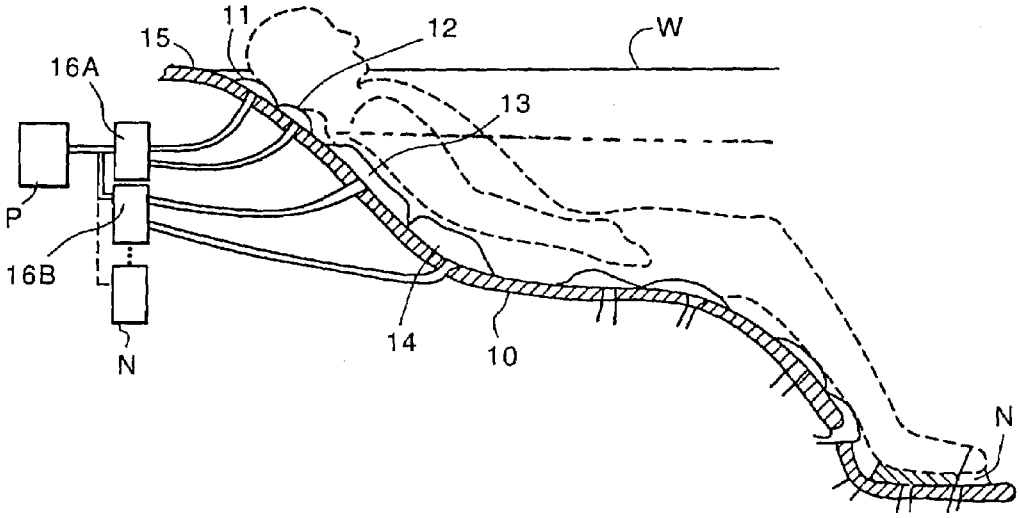
FIG. 2 is a possible bladder configuration for the fluidic massaging seat system shown in FIG. 1.

The fluidic controller switch has an input and multiple output. The given bladder will inflate until the backpressure caused by the occupant causes the output of the fluidic to switch to the next bladder in the series. At this point, the first bladder deflates through the vents in the fluidic controller. The sequence continues with the bladders inflating or filling and deflating or emptying based on the backpressure. The operating fluid can be either air or water. The system is as comprised as shown in FIG. 2 of a plurality of fluidic switches 16A and 16B. The bladders (13, 14, 15, 16. N) are mounted on the inside surface of the tub wall and arranged to provide specific massage of the neck, shoulders, back, ischial, thighs, calves and feet. More or less bladders and switch controllers can be used. The fluidic controller can take its input from either a dedicated pump P or a portioned flow from the existing air or water pump.

In its simplest form, the user is afforded an on/off control O/O of the massage and the opportunity to the user to additionally control the speed and intensity of the massage.

Figure 3:
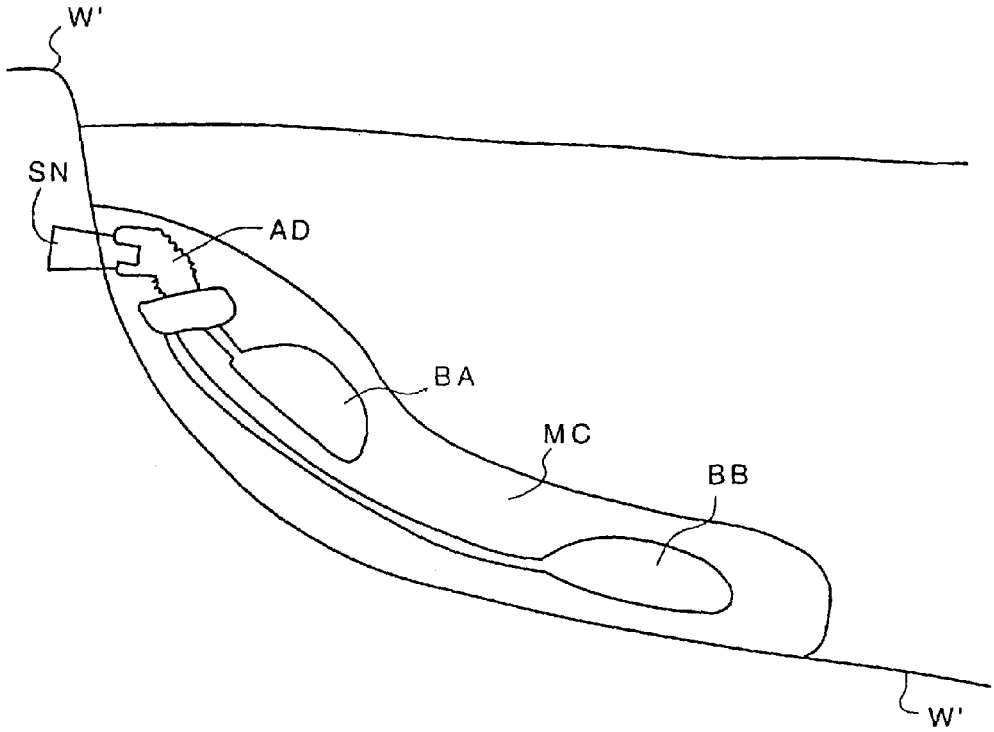
FIG. 3 is a sectional view of a further embodiment of the invention shown in the adaptation of the invention to an existing spa nozzle.
Figure 4A:
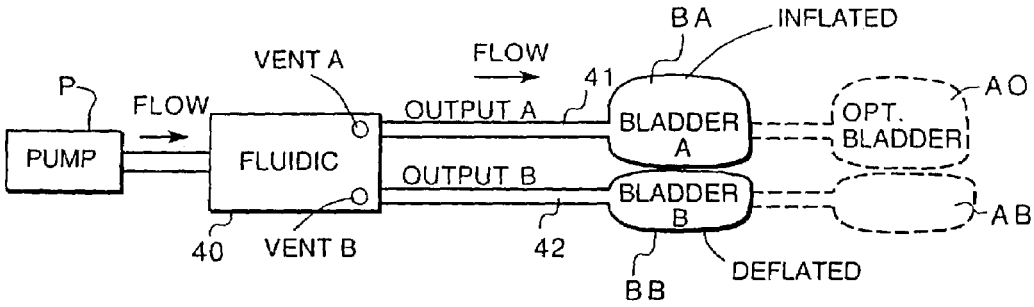
FIGS. 4A and 4B are schematic illustrations of the operation of the bladders shown in FIG. 3.
Figure 4B:
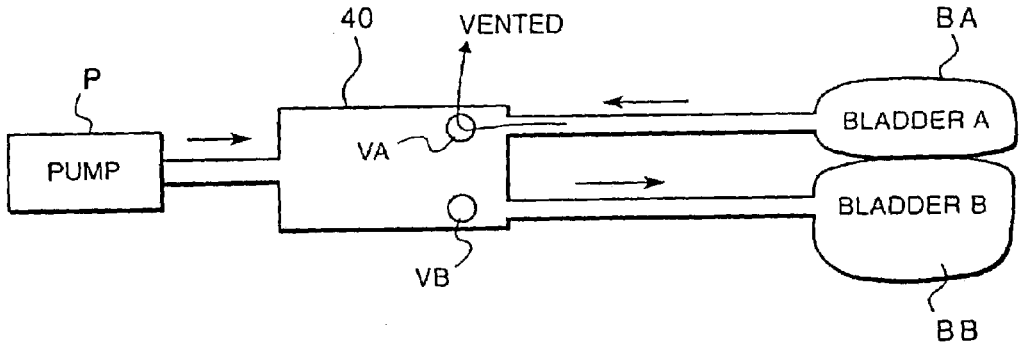

In the embodiment shown in FIGS. 3, 4A and 4B, the bladders BA, BB can be embedded in a mesh and cushioned MC and can be finely perforated. In this way, when the air is used as a working fluid, the air will bleed through the holes in the mesh to create a bubbly affect. The perforation can also be small enough so that the pressure accumulate in the bladders sufficiently to create the backpressure necessary for correct operation. As diagrammatically illustrated in FIGS. 4A and 4B, pump P supplies fluidic switch 40 with fluid under pressure. Switch 40 has a pair of output passages or channels 41, 42 coupled to bladders BA and BB, respectively. (Additional optional bladders AO and AB can be serially connected.) Bladder BA is shown as being inflated in FIG. 4A and then deflated and vented through vent VA in FIG. 4B. Bladder BB is shown as being inflated in FIG. 4B while bladder BA is being vented.

The system can be integrated into a spa by the manufacturer or offered as an after-market add-on system. In the OEM configuration, the supply to the fluidic could be plumbed in. Alternatively, the supply to the fluidic could be through an attachment of an adapter AD to one of the nozzles SN typically used in the hot tube as shown in FIG. 2.

Figure 6:
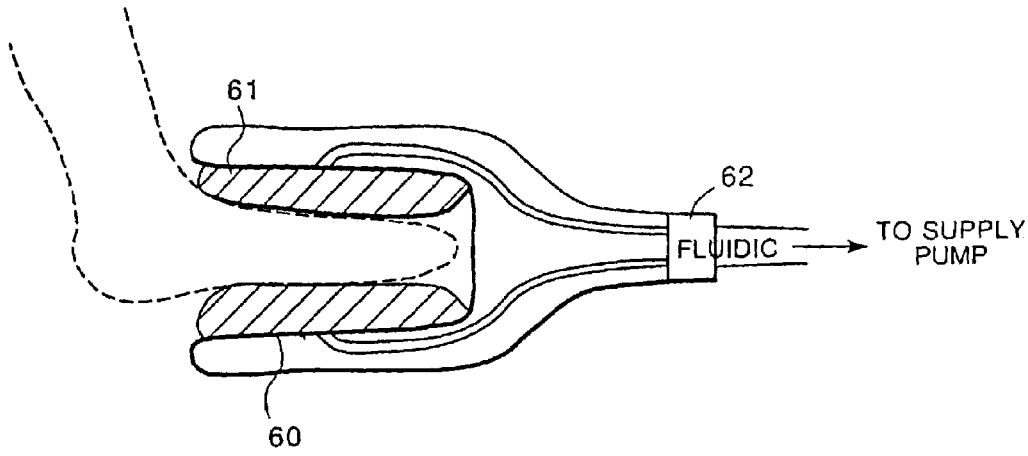
FIG. 6 is a sectional of the foot massage embodiment.

In the embodiment shown in FIG. 6, the bladders 60, 61 are configured in a pocket arrangement in which the user inserts his feet. The bladders 60, 61 are connected to the fluidic switch 62 in such a way that the alternately inflated bladders and deflated bladders alternately apply pressure on the tops and soles of the feet, respectively.

Referring now to FIGS. 5A–5D, the splitter 50 defines the receiver passages 56, 58 to the different bladders, and each receiver passage 56, 58 is vented 54, 55 to atmosphere by venting passages V1, V2.

Figure 5A:
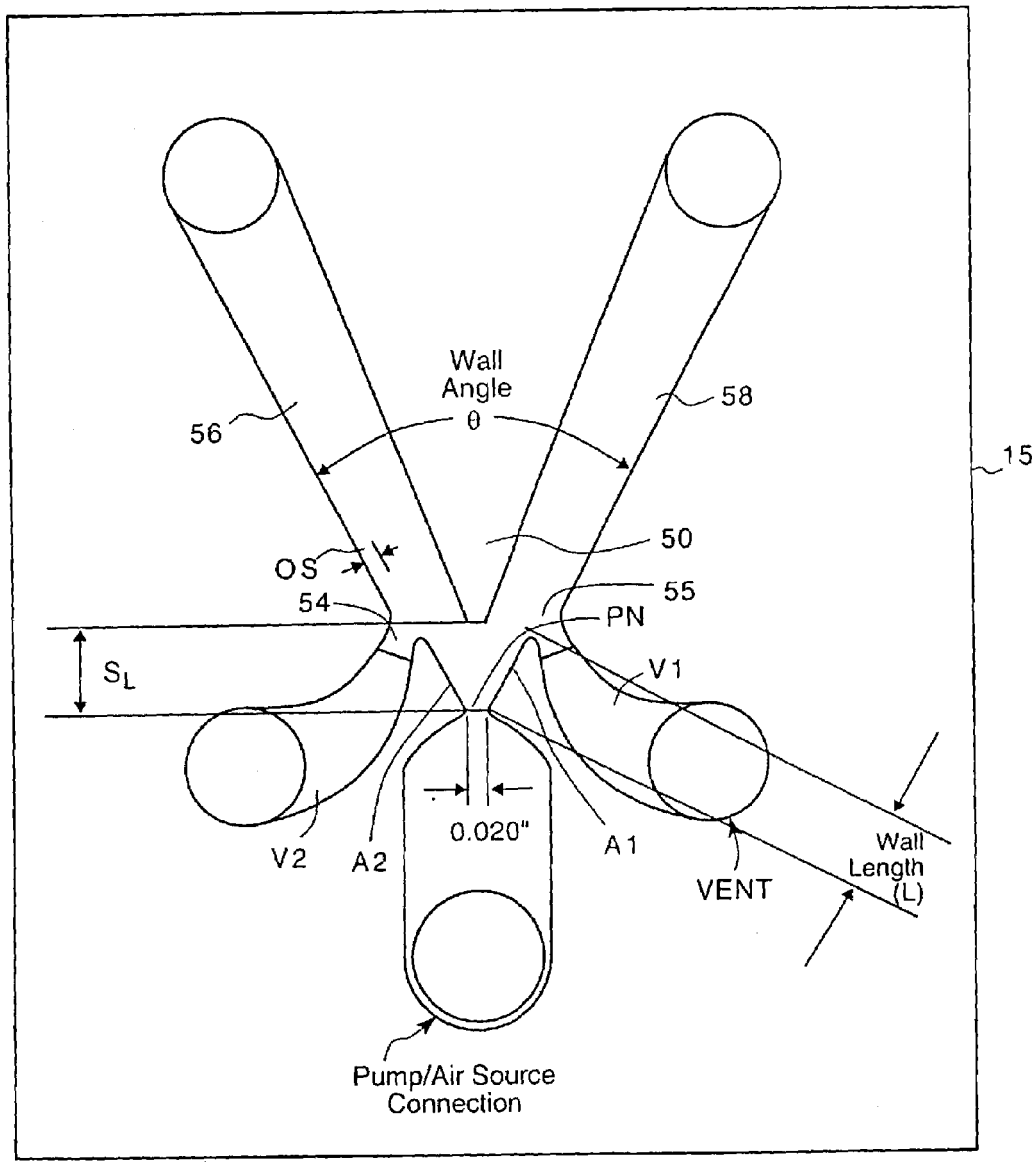
FIG. 5A is a diagrammatic illustration of a fluidic switch operated by backloading pressure from the receiver channels.
Figure 5B:
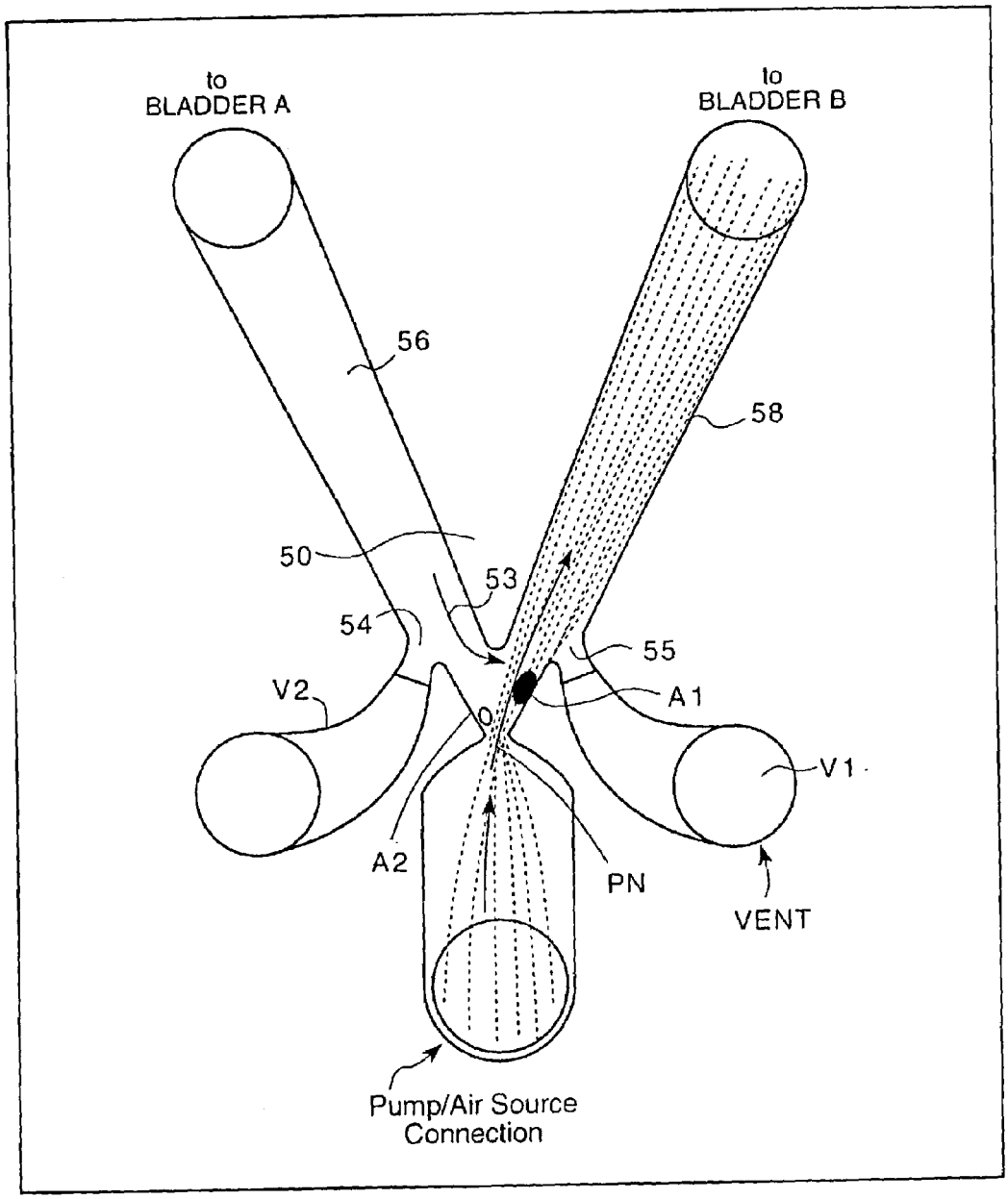
FIGS. 5B, 5C and 5D illustrate flow patterns to the bladders during filling and switching phases.
Figure 5C:
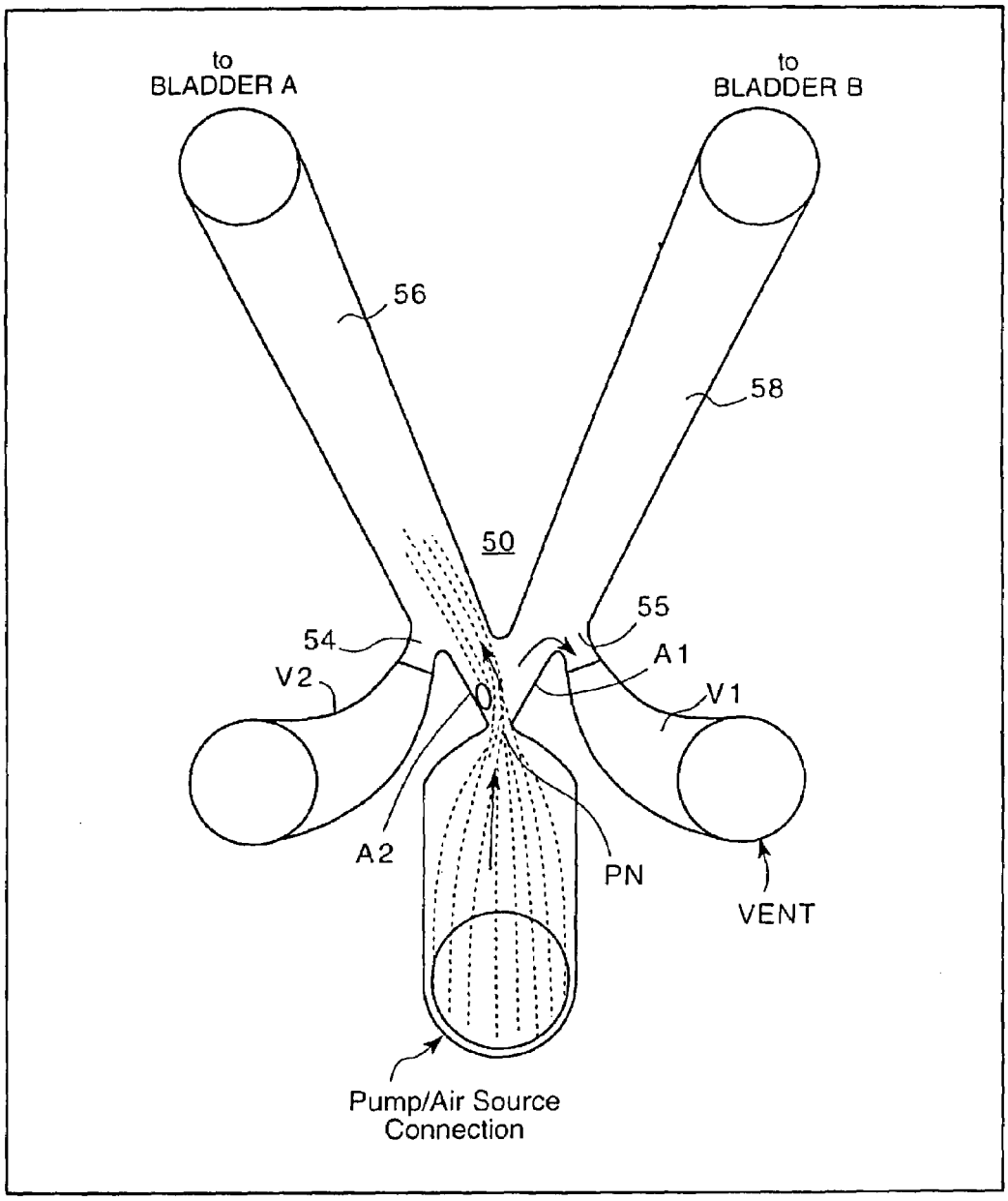
Figure 5D:
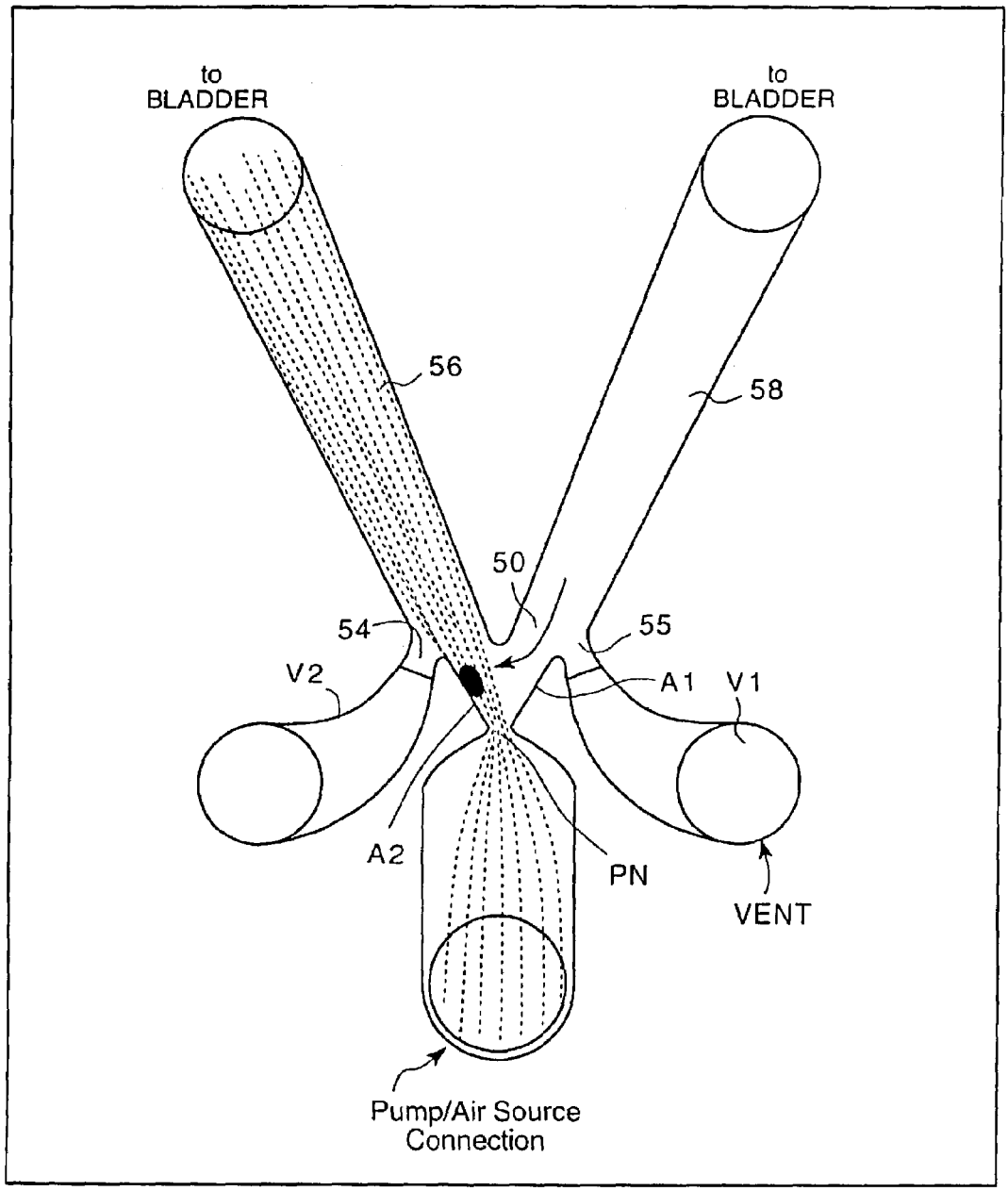

Referring now to FIGS. 5B, 5C and 5D, the flow patterns during bladder filling and switching are illustrated. In FIG. 5B, the jet of air is issued through the power nozzle PN and, in the state illustrated, the jet of air is directed into receiver passage 58 and due to the coanda bubble and wall attachment effect attaches to attachment wall A1 with the coanda bubble B1 shown as drawing air from the power jet flowing through receiver passage 58. Entrainment from receiver 56 is indicated by arrow 60. The receiver passage 58 is connected to the manifold 57 which is connected to fill bladders B1, B2 . . . BN. A weaker coanda or attachment bubble is shown on the non-filled side to receiver 56 and attachment wall A2. In the embodiment shown, when air is used as the working fluid and the wall angle Θ is about 40° and the splitter distance S1 is about 0.067", the length of the attachment walls is about 3W or 0.060", and the power nozzle W is about 0.020".

When the bladders or cells connected to receiver passage 58 are filled and can receive no more air, the backload overcomes the wall attachment on wall A1 (the coanda attachment) and the flow in the output channel or receiver 58 is partially diverted to the vent V1 (FIG. 5C) and the rest into left channel 56 which then fills the connected bladders. The coanda bubble is formed at the attachment wall A2 in the left channel or receiver channel 56, and the air in the connected bladder exhausts through the vent V1. In FIG. 5C, the bladders are shown as being filled by the jet of air and shows the entrainment of air from the receiver channel 58. When the connected bladders are fully inflated and can receive no more air and can inflate no further, the backloading pressure in receiver channel 56 overcomes the attachment at wall A2 and causes the reverse procedure to take place.

While the invention has been described in relation to preferred embodiments of the invention, it will be appreciated that other embodiments, adaptations and modification of the invention will be apparent to those skilled in the art.

What is claimed is:

1. A foot massaging system in which a fluidic switch is used to drive at least a pair of receiver channels connected to alternately inflate and deflate alternate bladder cells mounted above and below a human foot, said fluidic switch being constituted by a power nozzle projecting a jet of fluid towards a splitter, said splitter defining a pair of receiver channels, a pair of attachment walls adjacent said power nozzle and a pair of vents, one for each of the output receiver channels of said fluidic switch, whereby switching of said jet of fluid back and forth between said receiver channels and the alternate inflation and deflation of said bladder cells is caused when the backload in each receiver channel overcomes the wall attachment at its associated attachment wall.

2. The foot massaging system defined in claim 1 wherein said jet of fluid is water and said pair of vents are submerged.

3. The foot massaging system defined in claim 1 including a water container and wherein said water container has a plurality of submerged water nozzles therein and said power nozzle is connected to receive water from one of said submerged water nozzles.

* * * * *